US007856694B2

(12) United States Patent
Lee et al.

(10) Patent No.: US 7,856,694 B2
(45) Date of Patent: Dec. 28, 2010

(54) NOZZLE ASSEMBLY OF VACUUM CLEANER

(75) Inventors: Sung-cheol Lee, Seoul (KR); Jang-keun Oh, Gwangju (KR); Hwa-gyu Song, Gwangju (KR); Chae-hoon Sohn, Gwangju (KR); I-sun Park, Gwangju (KR)

(73) Assignee: Samsung Gwangju Electronics co., Ltd., Gwangju (KR)

( * ) Notice: Subject to any disclaimer, the term of this patent is extended or adjusted under 35 U.S.C. 154(b) by 0 days.

(21) Appl. No.: 12/008,293

(22) Filed: Jan. 10, 2008

(65) Prior Publication Data

US 2009/0038110 A1 Feb. 12, 2009

(30) Foreign Application Priority Data

Aug. 8, 2007 (KR) ..... 10-2007-0079834

(51) Int. Cl.
*A47L 5/26* (2006.01)
*A47L 9/00* (2006.01)
*A47L 5/00* (2006.01)

(52) U.S. Cl. ..... 15/387; 15/326

(58) Field of Classification Search ..... 15/387, 15/375, 326; 415/191, 116
See application file for complete search history.

(56) References Cited

U.S. PATENT DOCUMENTS 4,306,330 A * 12/1981 Jinkins ..... 15/325
6,813,809 B2 * 11/2004 Worwag ..... 15/387
2002/0120999 A1 * 9/2002 Worwag ..... 15/387
2006/0042041 A1 * 3/2006 Kim ..... 15/387
2006/0248680 A1 * 11/2006 Heidenga et al. ..... 15/387

FOREIGN PATENT DOCUMENTS

DE 4229030 3/1994
DE 10042672 2/2001
GB 2252901 8/1992

OTHER PUBLICATIONS

Extended European Search Report dated Feb. 19, 2010 corresponding to European Patent Application No. 08103092.6.

* cited by examiner

*Primary Examiner*—Joseph J Hail, III
*Assistant Examiner*—Jamal Daniel
(74) *Attorney, Agent, or Firm*—Ohlandt, Greeley, Ruggiero & Perle, LLP

(57) ABSTRACT

A nozzle assembly of a vacuum cleaner is provided that includes a casing, a suction port, a drum brush, a fan, and a blocking plate. The drum brush is rotatably disposed in the casing so drum bristles hit a surface being cleaned. The fan is disposed in the casing to be rotated by air drawn in through the suction port so that the fan rotates the drum brush. The blocking plate is adjacent to the front of the fan to screen most of the fan except for a lower portion of the fan. The fan includes a circular fan body, a shaft member, and a plurality of blades. The inside edge of each of the blades is at a distance from the shaft member so that the drawn-in air passes through a space defined between the inside edge of each of the blades and the shaft member.

15 Claims, 8 Drawing Sheets

NOZZLE ASSEMBLY OF VACUUM CLEANER

CROSS-REFERENCE TO RELATED APPLICATION

This application claims benefit under 35 U.S.C. §119(a) of Korean Patent Application No. 2007-0079834, filed Aug. 8, 2007 in the Korean Intellectual Property Office, the entire disclosure of which is hereby incorporated by reference.

BACKGROUND OF THE INVENTION

1. Field of the Invention

The present disclosure relates to a nozzle assembly of a vacuum cleaner, and more particularly, to a nozzle assembly of a vacuum cleaner capable of attenuating noise from a fan that drives a drum brush without compromising performance of the fan.

2. Description of the Related Art

Vacuum cleaners are among the most widely used home electronic appliances. Vacuum cleaners draw in air and dust from a surface being cleaned, using a suction force generated by a vacuum source.

Vacuum cleaners can clean a variety of places, including hard surfaces such as hard floors, and soft surfaces such as carpets or blankets. However, vacuum cleaners are not always convenient to use. Cleaning can be tiresome when cleaning fabrics such as carpets or blankets as the fabrics frequently stick to the vacuum cleaner.

Accordingly, conventional vacuum cleaners employ a drum brush inside a nozzle assembly and use a fan to drive the drum brush to prevent objects being cleaned from sticking to the nozzle assembly. This will be explained in greater detail below with reference to FIGS. 1 and 2.

FIG. 1 is a cross-section view of a conventional nozzle assembly having a drum brush and a fan, and FIG. 2 is a perspective view of a fan employed in the nozzle assembly of FIG. 1.

Referring to FIG. 1, a conventional nozzle assembly 1 includes a drum brush 4 and a fan 5 in an interior space defined between an upper casing 2 and a lower casing 3. The lower casing 3 includes a suction port 6 to draw in air and dust. Although not illustrated, the drum brush 4 and the fan 5 are connected by a belt. As the nozzle assembly 1 is pushed against a surface being cleaned and a vacuum cleaner is operated, air is drawn in through the suction port 6 of the lower casing 3, and the drawn-in air passes the fan 5. The fan 5 is made to rotate by the energy of air that passes therethrough. As the rotational force of the fan 5 is transmitted to the drum brush 4, the drum brush 4 rotates together with the fan 5. As the drum brush 4 rotates, drum bristles 4*a* formed on an outer circumference of the drum brush 4 hit the surface being cleaned, thereby preventing the surface being cleaned from sticking to the nozzle assembly 1, while particles on the surface are picked up.

A blocking plate 7 is disposed on the front of the fan 5 to increase the performance of the fan 5. The blocking plate 7 is generally formed as a rectangular plate. The blocking plate 7 reduces the area of the entrance to the fluid passage in the front of the fan 5, helping the fan 5 rotate at a high speed.

Referring to FIG. 2, the fan 5 includes a fan body 5*a*, a shaft member 5*b* extending from the center of the fan body 5*a* toward an axis of rotation, and a plurality of blades 5*c* arranged at regular intervals on a side of the fan body 5*a*. The plurality of blades 5*c* extend from the outer surface of the shaft member 5*b* and in a radial fashion on the fan body 5*a*. This type of fan, known as a centrifugal fan, in which the first ends of the blades 5*c* are integrally formed with the shaft member 5*b*, provides a relatively good fanning performance.

However, when implemented in a nozzle assembly 1 to drive the drum brush 4, the fan 5 causes a usually high-pitched agitating noise to be emitted from the nozzle assembly 1. This noise, which is called 'blade passage frequency noise (BPF)', is generated due to the blades 5*c* of the fast rotating fan 5 colliding with the air. A user may feel discomfort as the BPF noise increases.

SUMMARY OF THE INVENTION

Exemplary embodiments of the present disclosure overcome the above disadvantages and other disadvantages not described above. Accordingly, it is an object of the present disclosure to reduce noise generated by a fan that drives a drum brush, without compromising the performance of the fan.

An aspect of the present disclosure provides a nozzle assembly of a vacuum cleaner, which includes a casing comprising an upper casing and a lower casing, and a suction port formed in a lower portion of the lower casing, a drum brush comprising a plurality of drum bristles planted along the outer circumference thereof, the drum brush rotatably disposed in an interior space of the casing so the drum bristles hit a surface being cleaned, a fan disposed in the interior space of the casing to be rotated by air being drawn in through the suction port, the fan to provide the drum brush with a rotational force, and a blocking plate formed adjacently to the front of the fan to screen most of the fan except for a lower portion of the fan. The fan may include a circular fan body, a shaft member extending from the center of the circular fan body, and a plurality of blades formed on the circular fan body. The inside edge of each of the blades may be at a distance from the shaft member so that the drawn-in air passes through a space defined between the inside edge of each of the blades and the shaft member.

A rotational axis of the drum brush may be parallel to a rotational axis of the fan, and the blocking plate may be arranged vertically in front of the fan.

The blocking plate may include a straight portion parallel to a tangent to the outer circumference of the circular fan body, and a curved portion extending from the bottom of the straight portion and curved toward a lower portion of the fan.

The curved portion of the blocking plate may have a predetermined radius of curvature.

The straight portion of the blocking plate may have a rectangular shape, and the curved portion of the blocking plate has a bent rectangular shape, and the straight portion and the curved portion of the blocking plate may have the same width.

The ratio of the radius of the fan to the total width of the blocking plate may range from about 1:1.55 to about 1:1.65, and the ratio of the radius of the fan to the total height of the blocking plate may range from about 1:1.29 to about 1:1.39.

The ratio of the radius of the fan to the height of the curved portion of the blocking plate may range from about 1:0.5 to about 1:0.6, and the ratio of the radius of the fan to the radius of curvature of the inner side of the curved portion of the blocking plate may range from about 1:0.07 to about 1:1.17.

The ratio of the radius of the fan to the shortest distance of the curved portion of the blocking plate and the fan may range from about 1:0.05 to about 1:0.14.

The curved portion of the blocking plate may include a cutaway portion formed in one side of the lower edge thereof.

The cutaway portion may have a rectangular shape, the ratio of the radius of the fan to the width of the cutaway portion may range from about 1:0.4 to about 1:0.49, and the ratio of the radius of the fan to the height of the cutaway portion may range from about 1:0.4 to about 1:0.5.

The nozzle assembly employs a cross flown fan instead of a centrifugal fan to drive the drum brush, and thus reduces the overall noise and the BPF noise, and consequently reduces user's discomfort from hearing the agitating sound. The possible degradation of the performance of the fan, due to adopting a cross flow fan instead of a centrifugal fan, can be compensated by providing a curved portion at a lower side of the blocking plate which is formed in front of the fan. Furthermore, a cutaway portion formed in one side of the blocking plate helps prevent the degradation of suction rate due to the blocking plate.

BRIEF DESCRIPTION OF THE DRAWINGS

The above and other aspects of the present disclosure will be more apparent from the following detailed description of exemplary embodiments with reference to the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of exemplary embodiments of the disclosure. Accordingly, those of ordinary skill in the art will recognize that various changes and modifications of the embodiments described herein can be made without departing from the scope and spirit of the disclosure. Also, descriptions of well-known functions and constructions are omitted for clarity and conciseness.

Figure 1:
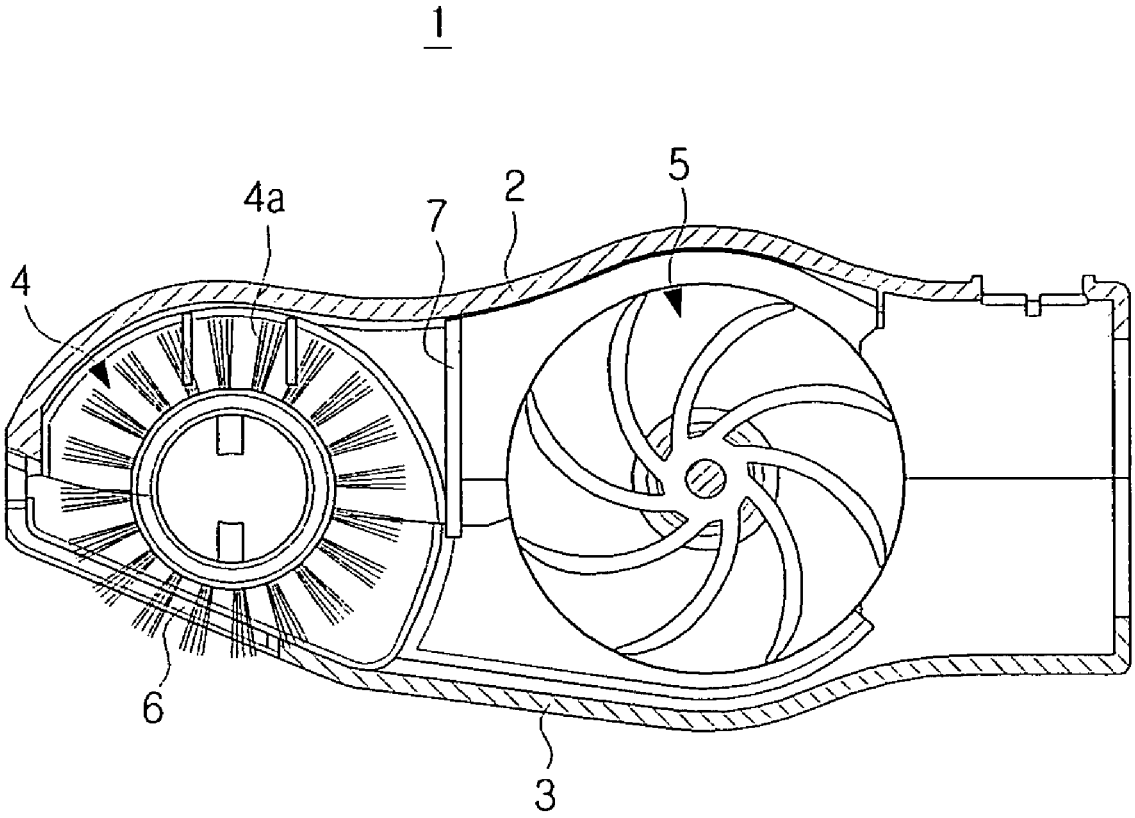
FIG. 1 (PRIOR ART)
FIG. 1 is a cross-section view of a conventional nozzle assembly having a drum brush and a fan.
Figure 2:
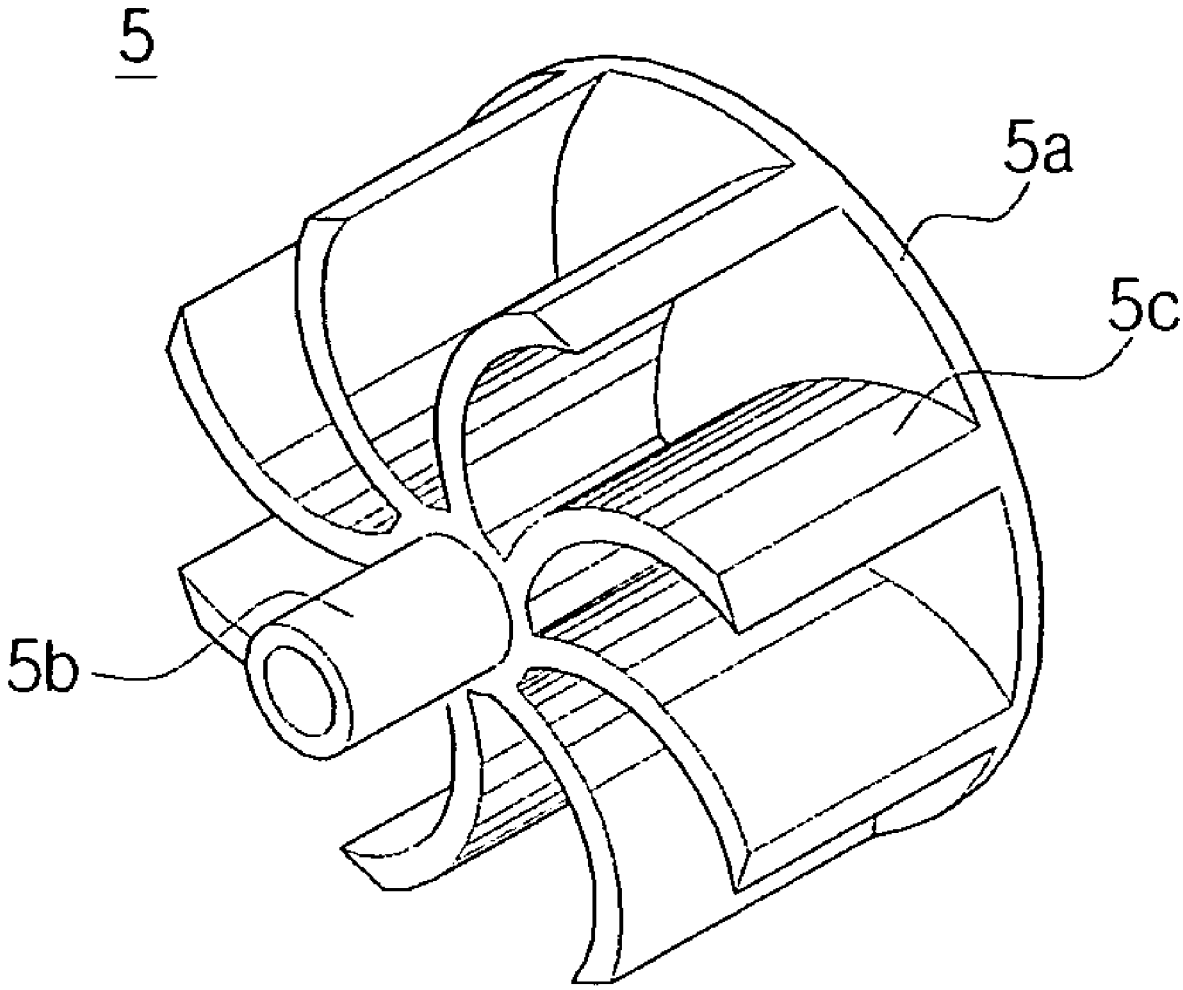
FIG. 2 (PRIOR ART)
FIG. 2 is a perspective view of a conventional fan employed in the nozzle assembly of FIG. 1.
Figure 3:
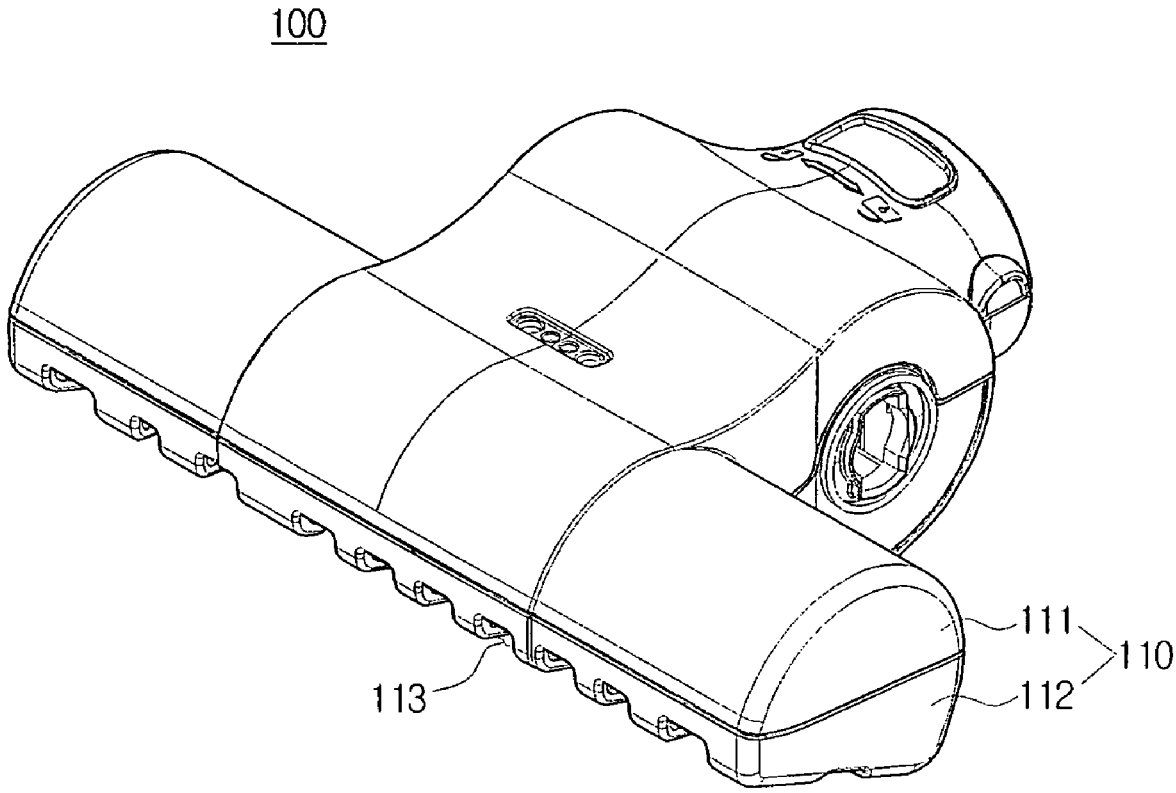
FIG. 3 is a perspective view of a nozzle assembly of a vacuum cleaner according to an exemplary embodiment of the present disclosure.
Figure 4:
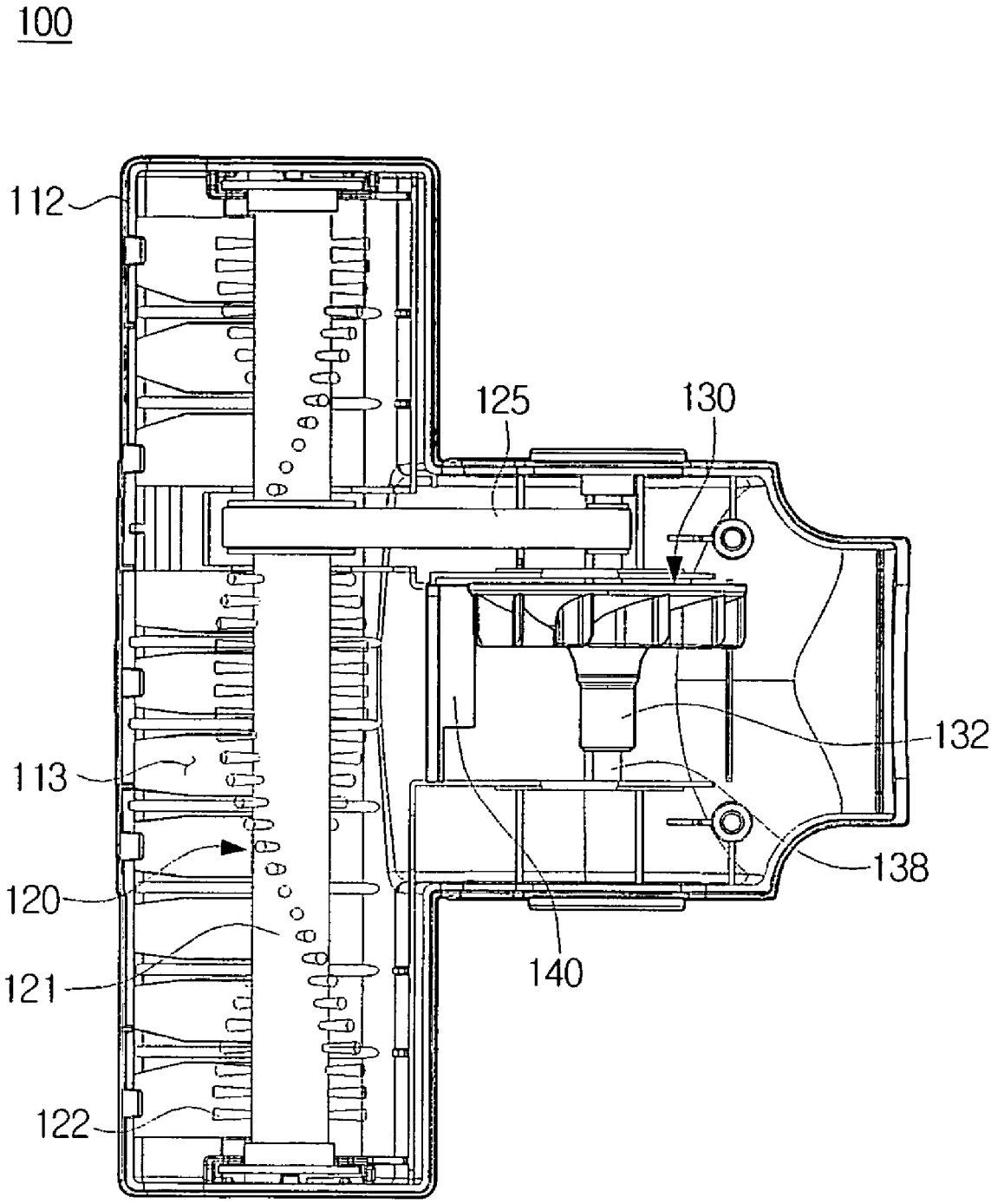
FIG. 4 is a top view illustrating an interior structure of the nozzle assembly of FIG. 3.
Figure 5:
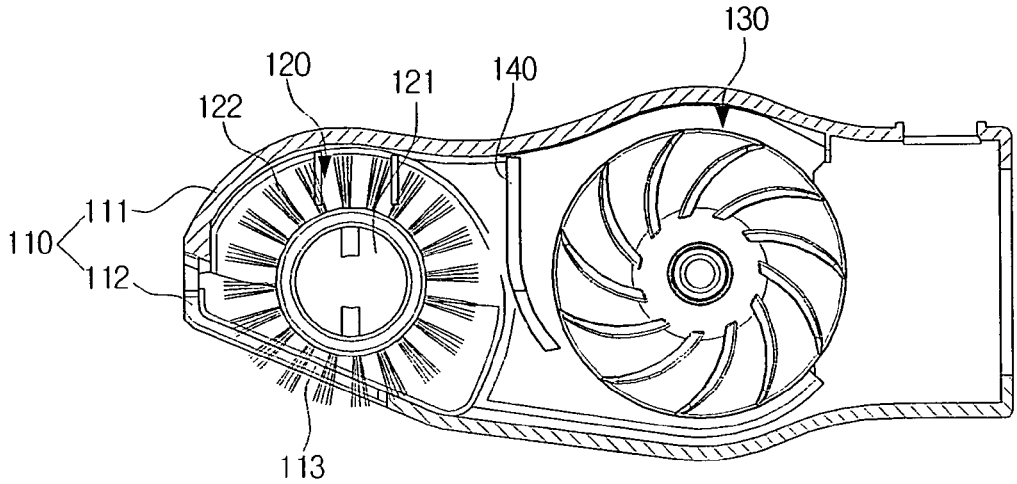
FIG. 5 is a cross-section view of the nozzle assembly of FIG. 3.

Referring to FIGS. 3 to 5, a nozzle assembly 100 of a vacuum cleaner according to an exemplary embodiment of the present disclosure includes a casing 110, a drum brush 120, a fan 130, and a blocking plate 140.

The casing 110 includes an upper casing 111 and a lower casing 112. The upper and lower casings 111, 112 are engaged with each other, so as to create an interior space in the casing 110. The lower casing 112 has a plurality of suction ports 113 formed on the bottom. Accordingly, outside air including contaminants from the surface being cleaned is drawn in through the suction ports 113 into the interior space of the casing 110.

The drum brush 120 is disposed in the interior space of the casing 110 so as to rotate. The drum brush 120 includes a cylindrical drum brush body 121, and a plurality of drum bristles 122 arranged along the outer circumference of the cylindrical drum brush body 121. One end of each of the drum bristles 122 is exposed outside of the casing 110 to contact a surface being cleaned.

As the cylindrical drum brush body 121 rotates, the drum bristles 122 collide with the surface being cleaned, keeping the surface being cleaned at a distance from the bottom of the lower casing 112. In this process, the drum bristles 122 also dig out the contaminants from the surface being cleaned.

The fan 130 is mounted in the interior space of the casing 110 and at a predetermined distance from the drum brush 120. The fan 130 may be made to rotate by the air that enters through the suction ports 113. The rotational force of the fan 130 may be transmitted to the drum brush 120 through a belt member 125 (FIG. 4) provided between the fan 130 and the drum brush 120.

Figure 6:
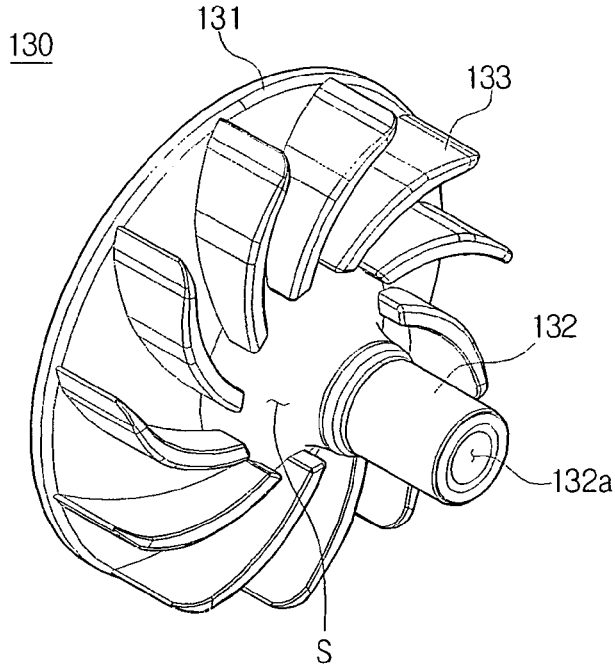
FIG. 6 is a perspective view of a fan employed in the nozzle assembly of FIG. 3.

Referring to FIG. 6, the fan 130 includes a circular fan body 131, a shaft member 132, and a plurality of blades 133.

The shaft member 132 extends from the center of the fan body 131 toward the rotational axis of the fan body 131. The shaft member 132 may be rotated integrally with the fan body 131, and formed at an acute angle with respect to the fan body 131. The shaft member 132 includes a piercing hole **132*a* formed at the center. A fan shaft 138 (FIG. 4) is disposed through the piercing hole 132*a*. Both ends of the fan shaft 138 are fixed at the inner sidewall of the casing 110. Accordingly, the fan 130 rotates about the fan shaft 138 fixed to the casing 110. The fan shaft 138 is arranged parallel to the rotational axis of the drum brush 120**.

The plurality of blades 133 are arranged at regular intervals on one side of the fan body 131, along the circumference. The movement energy of the incoming air is turned into a rotational energy of the fan 130 as the air collides with one side of each of the blades 133.

Referring to FIGS. 5 and 6, the inside edges of the blades 133 do not contact the shaft member 132, but are disposed at a predetermined distance from the shaft member 132, thereby creating a space (S) between the inside edges of the blades 133 on the one hand and the shaft member 132 on the other hand. External air, which is drawn in through the front side of the fan 130, passes the space (S) at the center of the fan 130, and is discharged through the rear end of the fan 130.

This type of fan 130 that has an empty space (S) at the center for the incoming air to pass through is generally called a 'cross flow fan.' One exemplary embodiment of the present disclosure employs a cross flow fan 130 to drive the drum brush 120. However, the cross flow fan 130 has a less effective performance than the conventional centrifugal fan 5 explained above, because air passes through the empty space (S) formed at the center of the cross flow fan 130 and thus less friction is generated between with the blades 133 of the fan 130.

However, use of the cross flow fan 130 provides a reduction in noise. The applicant conducted a test to check the noise reduction effect obtained by the use of the cross flow fan 130 and the centrifugal fan 5, the results of which are displayed in the graphical representation illustrated in FIG. 9. The applicant compared the results obtained by the centrifugal fan 5 and the cross flow fan 130 when tested under the same conditions. The dotted line indicates the data obtained by the centrifugal fan 5, while the solid line indicates the result obtained by the cross flow fan 130.

Figure 9:
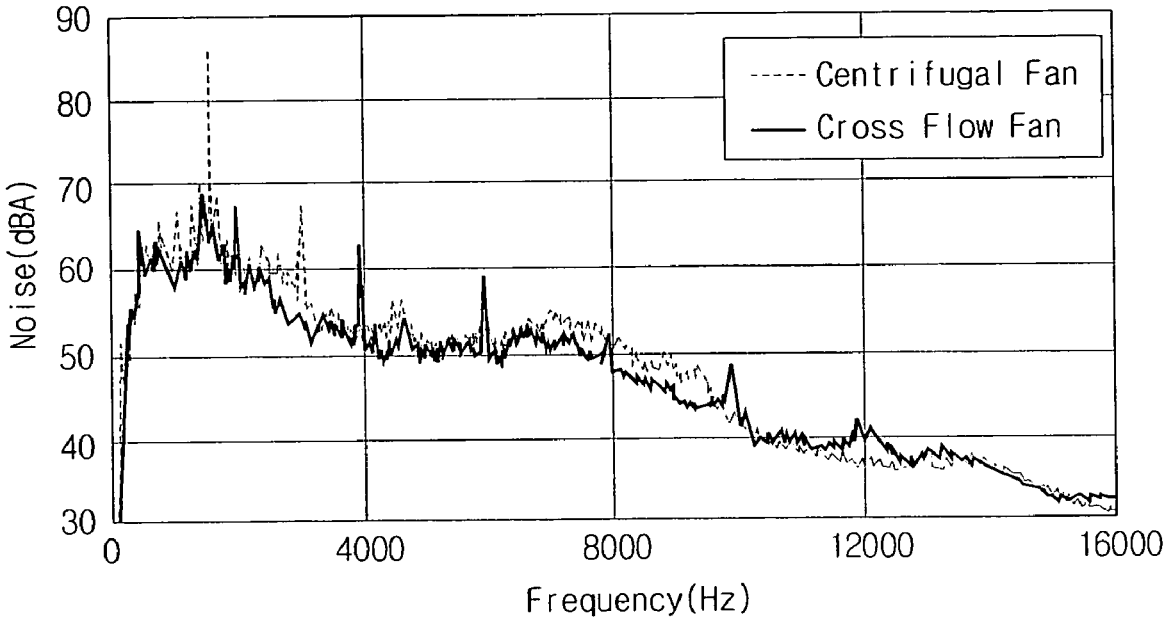
FIG. 9 is a view illustrating the test result regarding noise characteristics of a fan employed in the nozzle assembly of FIG. 3.

Referring to FIG. 9, the dotted line that represents the test result by the cross flow fan 130 indicates greater overall noise reduction than the solid line that represents the test result by the centrifugal fan 5. The graphical representation of FIG. 9 also includes a spot in the frequency area below 3500 Hz that has a surge of noise (dBA), and this is the spot where the BPF noise is generated. Accordingly, it can be understood from FIG. 9 that the cross flow fan 130 helps reduce the BPF noise more than the centrifugal fan 5 does.

Figure 7:
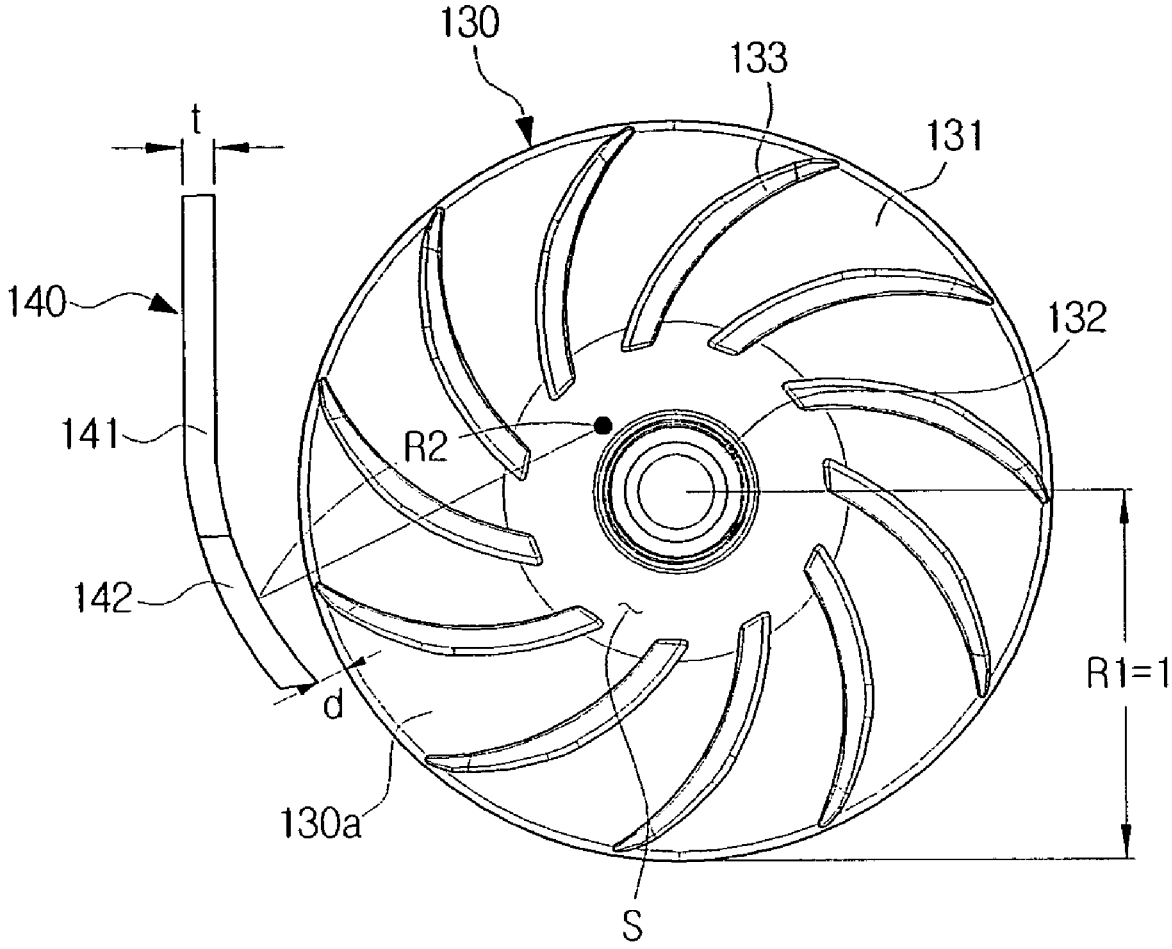
FIG. 7 is a side view of a fan and a blocking plate employed in the nozzle assembly of FIG. 3.
Figure 8:
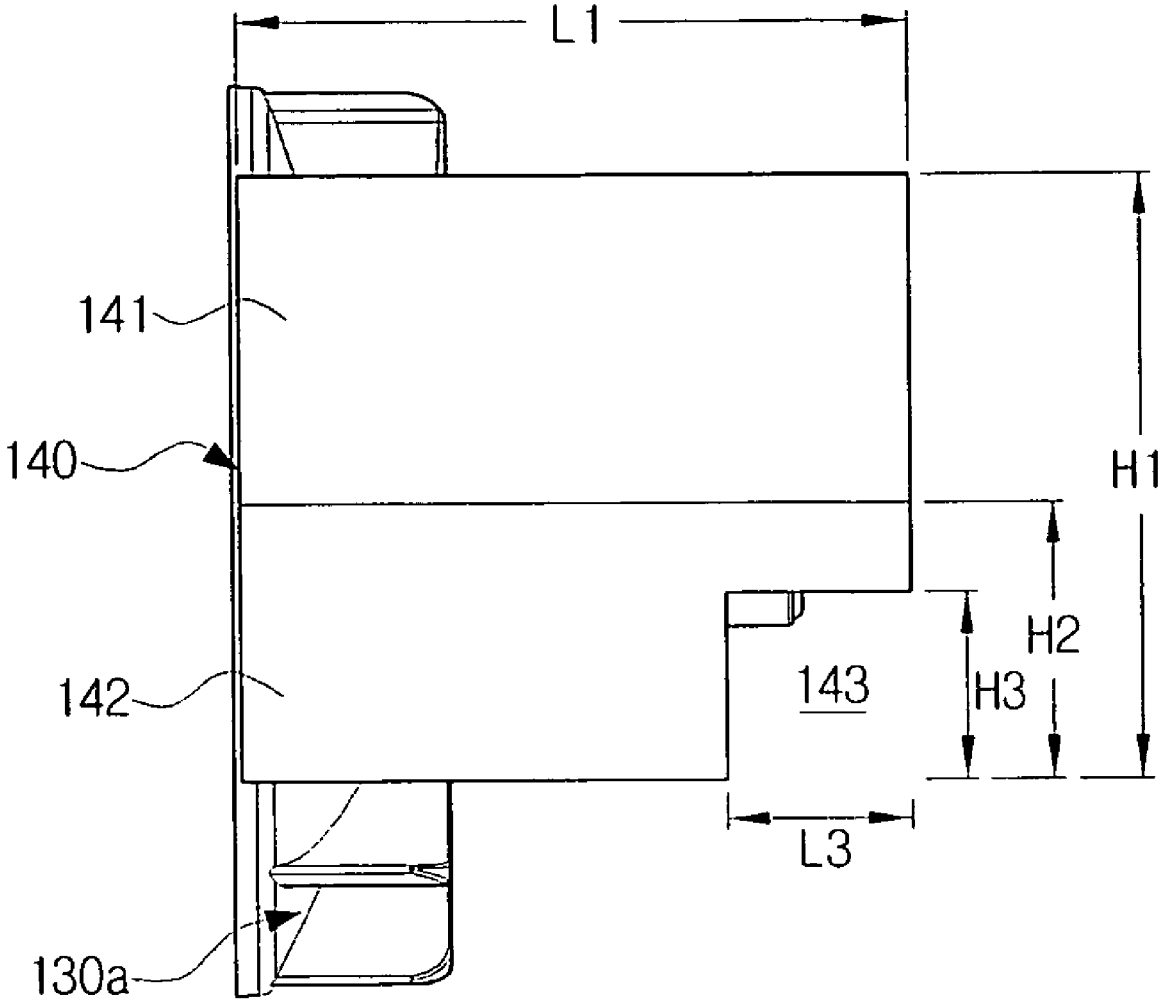
FIG. 8 is a front view of a fan and a blocking plate employed in the nozzle assembly of FIG. 3.

Referring to FIGS. 4, 5, 7 and 8, the blocking plate 140 is formed adjacent to the front of the fan 130, and is arranged vertically. Referring specifically to FIG. 8 which shows the fan 130 from the front, the blocking plate 140 screens most of the fan 130, excluding the lower side portion 130*a* of the fan 130. While the blocking plate 140 screens all but the lower side portion 130*a* of the fan 130 in this particular exemplary embodiment, one will understand that other alternatives are possible. For example, the blocking plate 140 may screen all but the upper side portion of the fan 130.

Referring to FIGS. 7 and 8, the blocking plate 140 includes a straight portion 141 in rectangular shape, and a curved portion 142 which also is in rectangular shape but is curved toward the external lower side portion 130*a* (FIG. 8) of the fan 130. The straight portion 141 of the blocking plate 140 is arranged vertically. The curved portion 142 of the blocking plate 140 extends integrally from the lower side of the straight portion 141. The straight portion 141 and the curved portion 142 have the same width (L1) in the region where the blocking plate 140 extends from the straight portion 141.

Unlike the conventional blocking plate, the blocking plate 140 according to the exemplary embodiment of the present disclosure includes the curved portion 142 in addition to the straight portion 141. When the air is drawn in, the air is guided toward the lower side portion 130*a* of the fan 130 smoothly along the curved portion 142 of the blocking plate 140. Accordingly, loss of movement energy is reduced because the incoming air collides with the blocking plate 140 less. Because relatively more energy can be transmitted from the air to the blades 133 of the fan 130, the fan 130 rotates at an increased speed, and provides better performance. Accordingly, the presence of the curved portion 142 of the blocking plate 140 according to the exemplary embodiment of the present disclosure compensates for the possible reduction in performance due to the use of the cross flow fan 130 instead of the centrifugal fan.

The blocking plate 140 reduces the area of fluid passage at the location where it is placed. However, if the area of fluid passage is reduced excessively by the blocking plate 140, the suction rate will fall. Accordingly, in order to prevent the area of the fluid passage from being reduced excessively by the blocking plate 140, the curved portion 142 of the blocking plate 140 has a rectangular cutaway portion 143 formed in one side. The shapes and sizes of the cutaway portion 143 may be changed appropriately according to the embodiments.

Through a series of tests, the applicant has obtained a desirable specification for the blocking plate 140 in consideration of the noise, performance of the fan 130, and the suction rate. The specification of the blocking plate 140 may change according to the size of the fan 140, and an example in which the fan body 131 has a radius (R1) of 1 will be explained below with reference to FIGS. 7 and 8.

The tests by the applicant revealed that the blocking plate 140 preferably has a total width (L1) of 1.55 to 1.65, and a total height (H1) of 1.29 to 1.39. The blocking plate 140 also preferably has a thickness (t) of 0.09, and the curved portion 142 preferably has a height (H2) of 0.5 to 0.6. The curved portion desirably has a radius of curvature (R2) ranging from 1.07 to 1.17. The cutaway portion 143, if rectangular in shape, desirably has a width (L3) of 0.4 to 0.49, and a height (H3) of 0.4 to 0.5. The shortest distance (d) between the curved portion 142 and the fan 130 is desirably from 0.05 to 0.14.

Thus, the ratio of the radius (R1) of the fan 130 to the total width (L1) of the blocking plate 140 ranges from about 1:1.55 to about 1:1.65, and the ratio of the radius (R1) of the fan 130 to the total height (H1) of the blocking plate 140 ranges from about 1:1.29 to about 1:1.39. Further, the ratio of the radius (R1) of the fan 140 to the height (H2) of the curved portion (142) of the blocking plate (140) ranges from about 1:0.5 to about 1:0.6, and the ratio of the radius (R1) of the fan 130 to the radius of curvature (R2) of the inner side of the curved portion 142 of the blocking plate 140 ranges from about 1:0.07 to about 1:1.17. Also, the ratio of the radius (R1) of the fan 130 to the shortest distance (d) of the curved portion 142 of the blocking plate 140 and the fan 130 ranges from about 1:0.05 to about 1:0.14.

The operation of the nozzle assembly 100 of a vacuum cleaner constructed and explained above will be explained below with reference to FIGS. 4 and 5.

As a user starts a vacuum cleaner, keeping the bottom of the lower casing 112 in contact with a surface of fabrics such as blanket or carpet, air including ambient contaminants is drawn into the interior space of the casing 110 through the suction ports 113 formed in the lower casing 112.

The drawn-in air passes the drum brush 120 and reaches the blocking plate 140. The air does not have a significant loss of movement energy while it is guided to the lower side portion 130*a* (FIG. 8) of the fan 130, because of the curved portion 142 formed in the lower part of the blocking plate 140. As a result, better fan 130 performance is provided than in a conventional case which employs the straight blocking plate 140 without a curved portion. The cutaway portion 143 formed at one side of the curved portion 142 of the blocking plate 140 also helps increase the area of the fluid passage at a location where the blocking plate 140 is disposed, and thus helps improve the suction rate in comparison with the conventional case.

The drawn-in air collides with the blades 133 of the fan 130, causing the fan 130 to rotate. As the fan 130 transmits rotational force to the drum brush 120 through the belt member 125, the drum bristles 122 planted on the outer circumference of the drum brush 120 hit the surface being cleaned. As a result, contaminants are removed from the surface being cleaned. By hitting the surface being cleaned, the drum bristles 122 help prevent fabrics such as blankets or carpets from sticking to the bottom of the lower casing 112.

The drawn-in air may pass the empty space (S) formed between the inside edge of the blades 133 and the shaft member 132, and be discharged to the rear side of the fan 130, while the air is passing through the cross flow fan 130. As explained above, because the nozzle assembly 100 adopts a cross flow fan 130 instead of a conventional centrifugal fan 5, the overall noise from the fan 130 is reduced and the BPF noise is also reduced.

As explained above, according to the exemplary embodiments of the present disclosure, the nozzle assembly 100 employs a cross flow fan 130 instead of a conventional centrifugal fan 5 to drive the drum brush 120, and thus reduces the overall noise and the BPF noise, and consequently reduces user's discomfort from hearing the agitating sound. The possible degradation of the performance of the fan 130, due to adopting a cross flow fan 130 instead of a centrifugal fan 5, can be compensated by providing a curved portion 142 at a lower side of the blocking plate 140 which is formed in front of the fan 130. Furthermore, a cutaway portion 143 formed in one side of the blocking plate 140 helps prevent the degradation of suction rate due to the blocking plate 140.

While certain exemplary embodiments of the present disclosure have been shown and described with reference to certain preferred embodiments thereof, it will be understood by those skilled in the art that various changes in form and details may be made therein without departing from the spirit and scope of the disclosure as defined by the appended claims and their equivalents.

What is claimed is:

1. A nozzle assembly of a vacuum cleaner, comprising:

a casing comprising an upper casing and a lower casing, and a suction port formed in a lower portion of the lower casing;

a drum brush comprising a plurality of drum bristles planted along an outer circumference thereof, the drum brush rotatably disposed in an interior space of the casing so the drum bristles hit a surface being cleaned;

a fan disposed in the interior space of the casing to be rotated by air being drawn in through the suction port, the fan to provide the drum brush with a rotational force; and a blocking plate being formed adjacently to a front of the fan to screen most of the fan except for a portion of the fan, wherein the fan comprises, a circular fan body, a shaft member extending from the center of the circular fan body, and a plurality of blades formed on the circular fan body, and wherein each of the blades have an inside edge that is at a distance from the shaft member so that the drawn-in air passes through a space defined between the inside edge of each of the blades and the shaft member, wherein the blocking plate comprises:

a straight portion parallel to a tangent to an outer circumference of the circular fan body;

a curved portion extending from a bottom of the straight portion and curved toward the portion of the fan; and a cutaway portion formed in the curved portion, wherein the curved portion has a lower end that is spaced apart from an inner surface of the lower casing.

2. The nozzle assembly of claim 1, wherein the drum brush has a rotational axis that is parallel to a rotational axis of the fan, and the blocking plate is arranged vertically in front of the fan.

3. The nozzle assembly of claim 2, wherein the curved portion of the blocking plate has a predetermined radius of curvature.

4. The nozzle assembly of claim 3, wherein the straight portion of the blocking plate has a rectangular shape, and the curved portion of the blocking plate has a bent rectangular shape, and the straight portion and the curved portion of the blocking plate have the same width.

5. The nozzle assembly of claim 4, comprising a ratio of a radius of the fan to a total width of the blocking plate that ranges from about 1:1.55 to about 1:1.65, and a ratio of the radius of the fan to a total height of the blocking plate that ranges from about 1:1.29 to about 1:1.39.

6. The nozzle assembly of claim 4, comprising a ratio of a radius of the fan to a height of the curved portion of the blocking plate that ranges from about 1:0.5 to about 1:0.6, and a ratio of the radius of the fan to the predetermined radius of curvature of an inner side of the curved portion of the blocking plate that ranges from about 1:0.07 to about 1:1.17.

7. The nozzle assembly of claim 4, comprising a ratio of a radius of the fan to a shortest distance of the curved portion of the blocking plate and the fan that ranges from about 1:0.05 to about 1:0.14.

8. The nozzle assembly of claim 4, wherein the cutaway portion has a rectangular shape, and wherein the blocking plate comprises a ratio of the radius of the fan to a width of the cutaway portion that ranges from about 1:0.4 to about 1:0.49, and a ratio of the radius of the fan to a height of the cutaway portion that ranges from about 1:0.4 to about 1:0.5.

9. The nozzle assembly of claim 1, wherein the portion of the fan comprises a lower portion of the fan.

10. A nozzle assembly of a vacuum cleaner, comprising:

a casing defining an interior space and a plurality of suction ports;

a drum brush rotatably disposed in the interior space;

a cross flow fan rotatably disposed in the interior space;

a belt member provided between the cross flow fan and the drum brush so that the rotational force of the cross flow fan is transmitted to the drum brush; and a blocking plate formed adjacent to a front of the cross flow fan to screen most of the cross flow fan except for a portion of the cross flow fan, wherein the blocking plate comprises a straight portion parallel to a tangent to an outer circumference of the cross flow fan and a curved portion extending from a bottom of the straight portion and curved toward the portion of the fan, wherein the curved portion has a cutaway portion formed therein, and wherein the curved portion has a lower end that is spaced apart from an inner surface of the lower casing.

11. The nozzle assembly of claim 10, wherein the portion of the cross flow fan comprises a lower portion.

12. The nozzle assembly of claim 10, comprising a ratio of a radius of the cross flow fan to a total width of the blocking plate ranges from about 1:1.55 to about 1:1.65, and a ratio of the radius of the cross flow fan to a total height of the blocking plate ranges from about 1:1.29 to about 1:1.39.

13. The nozzle assembly of claim 10, comprising a ratio of a radius of the cross flow fan to a height of the curved portion of the blocking plate ranges from about 1:0.5 to about 1:0.6, and a ratio of the radius of the fan to a radius of curvature of an inner side of the curved portion of the blocking plate ranges from about 1:0.07 to about 1:1.17.

14. The nozzle assembly of claim 10, comprising a ratio of a radius of the fan to a shortest distance of the curved portion of the blocking plate and the fan ranges from about 1:0.05 to about 1:0.14.

15. The nozzle assembly of claim 10, wherein the cutaway portion has a rectangular shape, and wherein the blocking plate comprises a ratio of a radius of the fan to a width of the cutaway portion that ranges from about 1:0.4 to about 1:0.49, and a ratio of the radius of the fan to a height of the cutaway portion that ranges from about 1:0.4 to about 1:0.5.

* * * * *